US007485020B2

(12) United States Patent
Nakamura et al.

(10) Patent No.: US 7,485,020 B2
(45) Date of Patent: Feb. 3, 2009

(54) OUTBOARD MOTOR

(75) Inventors: Daisuke Nakamura, Shizuoka-ken (JP); Isao Fujii, Shizuoka-ken (JP); Ken Wakui, Shizuoka-ken (JP)

(73) Assignee: Yamaha Marine Kabushiki Kaisha, Shizuoka-Ken (JP)

( * ) Notice: Subject to any disclaimer, the term of this patent is extended or adjusted under 35 U.S.C. 154(b) by 0 days.

(21) Appl. No.: 11/504,317

(22) Filed: Aug. 15, 2006

(65) Prior Publication Data

US 2007/0042651 A1 Feb. 22, 2007

(30) Foreign Application Priority Data

Aug. 19, 2005 (JP) ..... 2005-238760

(51) Int. Cl.
*B63H 20/32* (2006.01)

(52) U.S. Cl. ..... 440/76; 440/75; 440/78

(58) Field of Classification Search ..... 440/76, 440/78, 75

See application file for complete search history.

(56) References Cited

U.S. PATENT DOCUMENTS 2,489,478 A * 11/1949 Buske ..... 440/88 R
2,943,592 A * 7/1960 Benson et al. ..... 440/78
3,841,130 A * 10/1974 Scott et al. ..... 72/70
6,033,274 A * 3/2000 Mizuguchi et al. ..... 440/89 R
6,099,370 A * 8/2000 Tanaka et al. ..... 440/75
6,146,222 A * 11/2000 Murata et al. ..... 440/83
2006/0116034 A1 * 6/2006 Nakamura ..... 440/75

FOREIGN PATENT DOCUMENTS

JP 08-034394 2/1996

* cited by examiner

*Primary Examiner*—Lars A Olson
(74) *Attorney, Agent, or Firm*—Knobbe, Martens, Olson & Bear, LLP

(57) ABSTRACT

An outboard motor includes a case extending generally vertically and supported on a hull. An engine is supported at an upper end of the case. A propeller is supported by a lower end of the case. A drive shaft is supported within the case for rotation about a generally vertical axis. The driveshaft has an upper end operatively connected to the engine and a lower end operatively connected to the propeller. An upper portion of the case includes an elongate extruded portion having substantially the same cross-sectional shape along its length.

13 Claims, 7 Drawing Sheets

OUTBOARD MOTOR

CROSS-REFERENCE TO RELATED APPLICATIONS

This application claims priority to Japanese Application No. 2005-238,760, which was filed on Aug. 19, 2005, the entirety of which is hereby incorporated by reference.

BACKGROUND

1. Field of the Invention

The present invention relates to an outboard motor having a case that forms an outer shell of the outboard motor. More specifically, the present invention relates to an outboard motor in which the case comprises an extrusion.

2. Description of the Related Art

Typical outboard motors include an internal combustion engine adapted to drive a driveshaft, which in turn drives a propeller shaft. The engine usually is enclosed within a cowling, and a casing generally encloses the driveshaft and propeller shaft. The casing typically includes an upper case that is generally vertically-directed so as to generally enclose the driveshaft. A lower case generally encloses the propeller shaft, and often encloses gearing through which the driveshaft and propeller shaft communicate.

An example outboard motor is disclosed in Japanese Patent Document JP-A-Hei 8-34394. In this publication, the outboard motor includes a casing having a generally vertically-extending upper case. A driveshaft is contained in an internal space defined within the upper case. In the illustrated embodiment, the upper case is formed by casting a metal, and has a relatively complex, curved shape. A lower case generally contains the propeller shaft, and is also formed by casting a metal.

Components such as the upper and lower cases tend to be heavy. Also, casting metal can be a cumbersome process. Thus, typical upper cases formed by casting metal tend to be heavy and cumbersome to manufacture.

Further, typical outboard motors employ water-cooled engines. In such motors, water from below the surface is used as cooling water. Such cooling water is typically drawn into the lower case and then directed through a water passage formed in the internal space of the upper/lower cases to be supplied to the engine for cooling purposes. The water passage typically increases a cross-section of the case. Such a large-cross-section case tends to create a significant propulsion resistance for the associated boat.

SUMMARY

Accordingly, there is a need in the art for an outboard motor with a case having reduced weight. There is also a need in the art for an outboard motor having a case that is streamlined so as to decrease propulsion resistance as the case moves through the water.

In accordance with one embodiment, the present invention provides an outboard motor adapted to be mounted to a hull of a watercraft. The outboard motor comprises an engine adapted to drive a generally vertically oriented driveshaft. The driveshaft is adapted to drive a propulsion shaft. An upper case extends generally vertically and is adapted to fit circumferentially about at least a portion of the driveshaft. A lower case is adapted to fit about at least a portion of the propulsion shaft. The upper case comprises an elongate extrusion portion, and a cross-sectional planar shape of the extrusion portion being substantially constant throughout its length.

In another embodiment, the extrusion portion has an outer surface, and a cross-section of the extrusion portion taken at a plane transverse to a longitudinal center line of the extrusion portion has a major axis and a minor axis, the major axis being greater than the minor axis. In another embodiment, the extrusion portion is generally elliptical in cross-section.

In yet another embodiment, the hull is adapted to float in a body of water, and the outboard motor is configured so that when the hull is floating in a body of water a portion of the extrusion portion is under a surface of the water.

In still another embodiment, the engine is an air-cooled engine.

In a further embodiment, an upper member is fitted to an upper end of the extrusion portion, and a fastener connects the extrusion to the upper member. In a still further embodiment, the upper member is formed by casting. In yet another embodiment, the upper member comprises a depending portion shaped and configured to complementarily engage the upper end of the extrusion portion. In a yet further embodiment, the upper member additionally comprises a flange portion formed integrally with the depending portion, and the flange portion extends outwardly relative to the depending portion. In another embodiment, the upper end of the extrusion portion substantially abuts the flange portion.

In another embodiment, the present invention provides a method of making an outboard motor. The method comprises providing an engine adapted to drive an elongate driveshaft and providing a case adapted to generally enclose the driveshaft along a portion of its length. Providing the case comprises extruding an elongate tubular portion, and arranging the elongate extruded portion over the driveshaft.

In yet another embodiment, the extruded portion comprises an aluminum alloy. In yet a further embodiment, a planar cross-section of the extruded portion is substantially the same throughout its length.

DETAILED DESCRIPTION OF PREFERRED EMBODIMENTS

In order to describe the present invention in more detail, an embodiment thereof is hereinafter described with reference to the accompanying figures.

Figure 1:
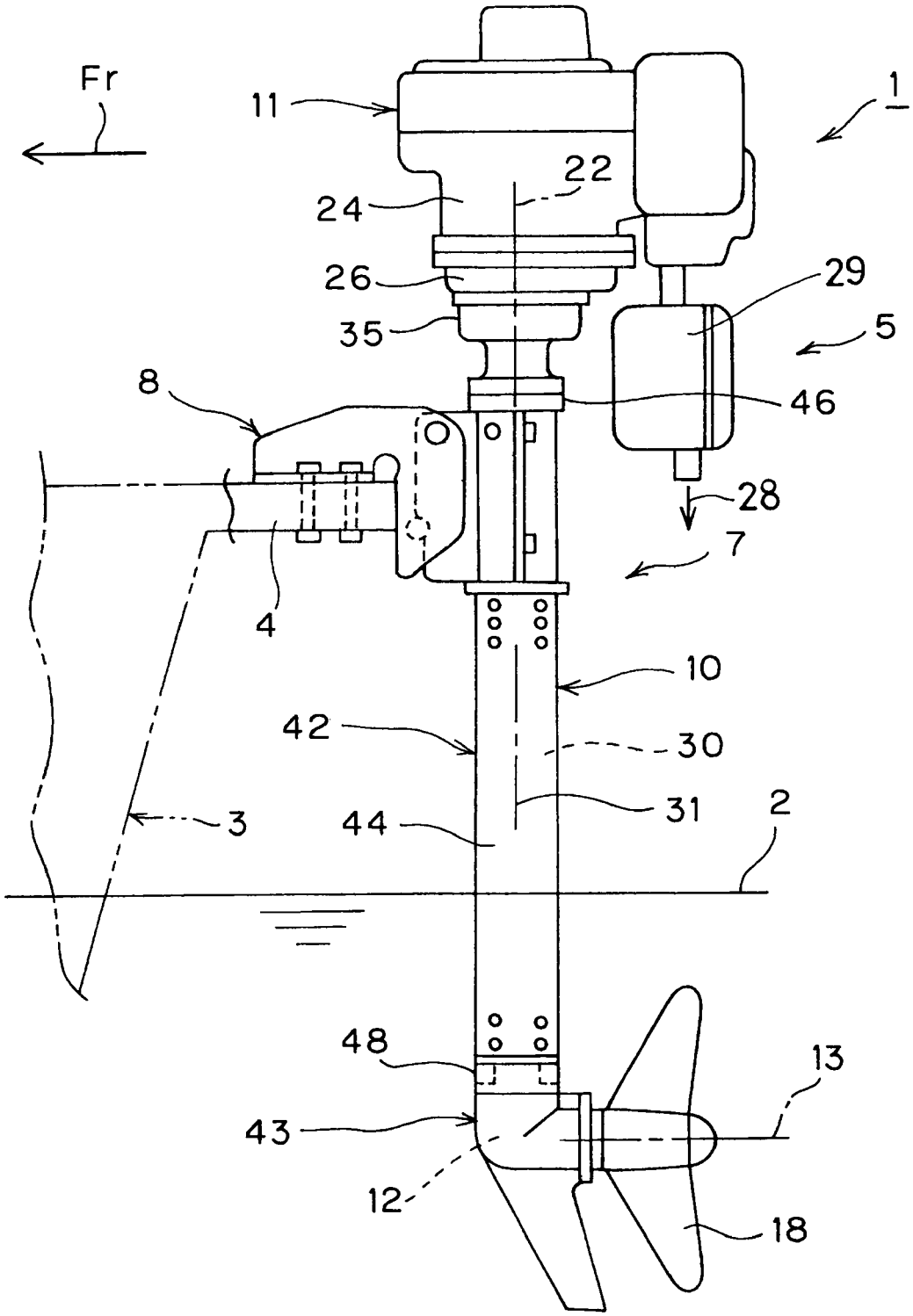
FIG. 1 is a side view of an outboard motor.

In FIG. 1, reference numeral 1 denotes a boat floating on the water surface 2, and an arrow Fr indicates a forward direction in which the boat 1 is propelled.

The boat 1 has a hull 3, and an outboard motor 5 supported with a horizontal plate 4 provided on the side of the hull 3. The outboard motor 5 includes: an outboard motor body 7 for generating a propulsive force to drive the hull 3 ahead; and a bracket 8 for supporting the outboard motor body 7 on the horizontal plate 4.

In the illustrated embodiment, the outboard motor body 7 preferably includes: an aluminum-alloy casting case 10 that extends in the approximately vertical direction and is supported on the side of the hull 3 with the bracket 8; an engine 11 supported on the case 10 at its upper side; a propeller shaft 16 that is contained in an internal space 12 of the case 10 at its lower end, and is supported on the case 10 with a front and a rear bearing 14, 15 such that the propeller shaft 16 is rotatable about a first axis 13 extending in a generally horizontal direction, or the longitudinal direction of the hull 3; a propeller 18 supported with a fastener 17 at the rear of the propeller shaft 16 which protrudes rearward from the lower end of the case 10; and a circular sealing member 19 provided about the first axis 13 and interposed between an inner circumferential surface at the rear end of the internal space 12 of the case 10 at its lower end and an outer circumferential surface of the propeller shaft 16.

The engine 11 preferably is a four-stroke, single-cylinder, air-cooled internal combustion engine. The engine 11 preferably includes a crankcase 24 for supporting a crankshaft 23 whose axis 22 extends in a generally vertical direction; an oil pan 26, which is mounted to the crankcase 24 to close a lower end opening of the crankcase 24 so as to reserve lubricant oil 25; a bearing 27 with which the oil pan 26 supports the lower end of the crankshaft 23; and a muffler 29 for directly discharging exhaust gas 28 in the air while the engine 11 is driven.

The outboard motor body 7 preferably includes: a drive shaft 34 that is contained in an internal space 30 of a longitudinal midsection of the case 10, and that is supported on the case 10 with an upper and a lower bearing 32, 33 such that the drive shaft 34 is rotatable about an approximately vertical second axis 31; a planetary reduction gear 35, which is interposed between the upper end of the case 10 and the engine 11, for operatively connecting the drive shaft 34 to the lower end of the crankshaft 23; a bevel drive gear 37, which is contained in the internal space 12 of the case 10 at its lower end and is fitted and supported with spline teeth 36 at the lower end of the drive shaft 34; and a driven gear 39, which is contained in the internal space 12 and is engaged with spline teeth 38 at a front end (free end) of the propeller shaft 16.

The second axis 31 is coaxial with the axis 22 of the crankshaft 23, and preferably is generally perpendicular to the first axis 13. The drive gear 37 and the driven gear 39 preferably are of the same shape and size, so they are compatible with each other.

The case 10 preferably is divided into an upper case 42 and a lower case 43. The upper case 42 includes: an elongate extrusion portion 44 that forms a longitudinal midsection of the case 42 and extends in a generally elongate vertical direction; an upper member 46 fastened to the upper end of the extrusion 44 with one or more fasteners 45; and a lower member 48 fastened to the lower end of the extrusion 44 with one or more fasteners 47.

Preferably, the extrusion portion 44 is extruded from an aluminum alloy. The upper and lower members 46, 48 preferably are made by aluminum alloy casting. In this illustrated embodiment, the fasteners 45, 47 connecting the extrusion 44 and members 46, 48 are rivets. The extrusion 44 is substantially straight. Preferably, longitudinal cross-sectional planes taken of the extrusion portion 44 are all formed into an ellipse having a major axis extending in the longitudinal direction of the boat 1. Preferably, the extrusion portion 44 is substantially uniform along its length so that all the cross-sectional planes are of the same shape and size. An axis of the extrusion 44 preferably lies generally on the second axis 31. A longitudinal midsection of the extrusion 44 lies at or on the water surface 2 while a bottom part of the extrusion 44 preferably is under the water surface 2 during use as shown in FIG. 1.

Figure 3:
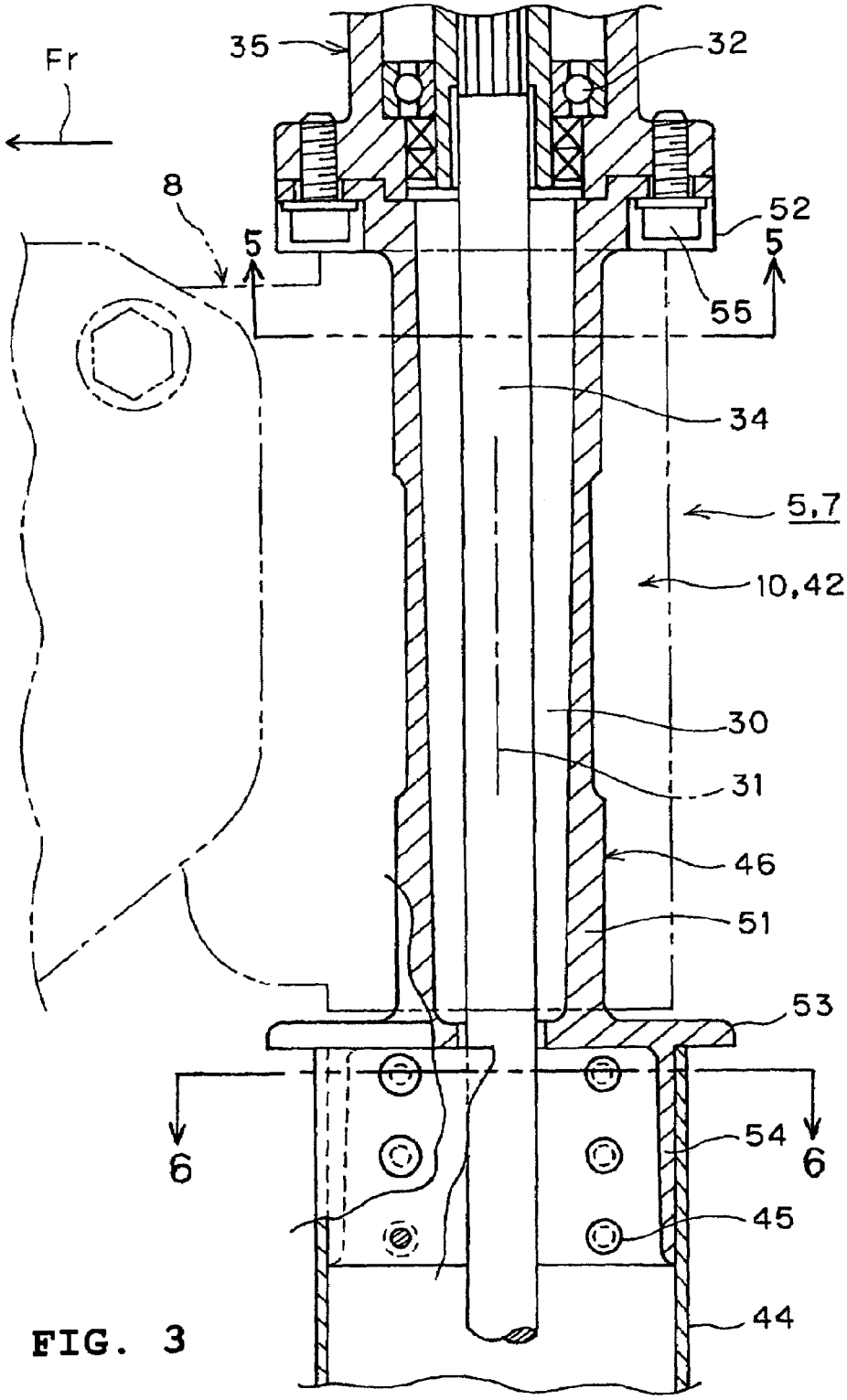
FIG. 3 is a side sectional view of a mid-portion of the outboard motor.
Figure 5:
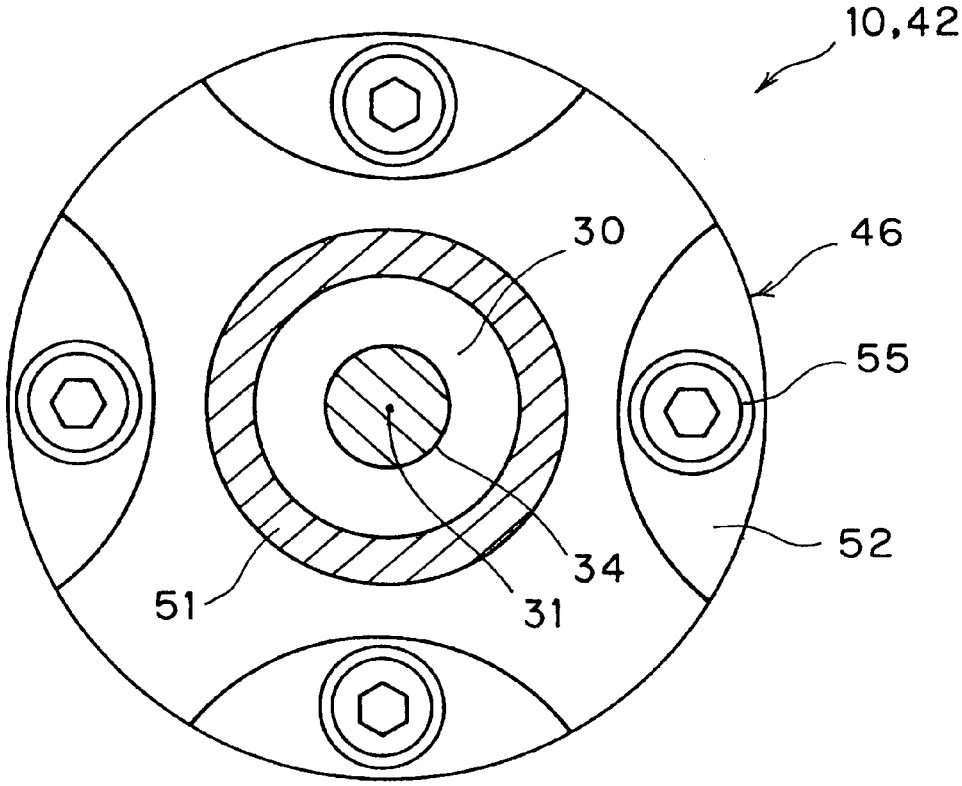
FIG. 5 is a bottom plan view of an outward-extending flange taken along line 5-5 of FIG. 3.

The axis of the upper member 46 preferably also lies on the second axis 31. With particular reference to FIGS. 3 and 5, the upper member 46 preferably includes: a cylindrical upper member body 51 supported on the side of the hull 3 with the bracket 8; an outward-extending flange 52 formed integrally with the upper end of the upper member body 51; an outward-extending flange 53 formed integrally with the lower end of the upper member body 51; and a cylindrical portion 54 that is integral with the outward-extending flange 53 and protrudes downward from the bottom thereof.

Figure 6:
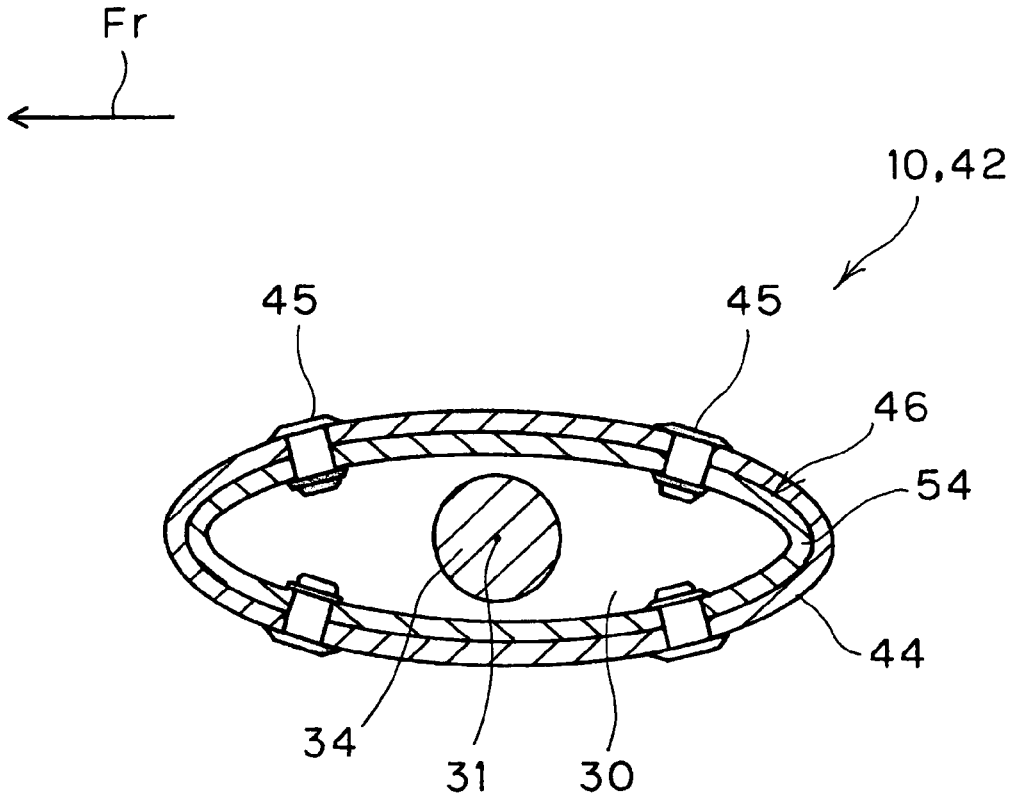
FIG. 6 is a cross-sectional view showing a connection between an extrusion or the upper case and an upper member, taken along line 6-6 of FIG. 3.

With particular reference to FIGS. 3 and 6, preferably the cylindrical portion 54 is shaped and sized complementarily to the extrusion so as to fit in tight contact with the upper end of the extrusion 44 in the longitudinal direction. In the illustrated embodiment, the elliptical cylindrical portion 54 is fitted into the inner surface of the extrusion 44, which has an elliptical cross-section. The extrusion 44 and the cylindrical portion 54 of the upper member 46 preferably are fastened together with the fastener 45 at their fitting points. It is to be understood that, in other embodiments, the extrusion 44 and portion 54 may be shaped differently than the elliptical cylindrical shapes shown herein. For example, in further embodiments they may be generally circular in cross-section or employ other shapes having other hydrodynamic properties.

The outward-extending flange 52 is connected together with the crankcase 24 via the reduction gear 35 with a tightening member 55 such as a bolt. In a preferred embodiment, a liquid sealing member is interposed between the upper end of the extrusion 44 and the cylindrical portion 54. The top end face of the extrusion 44 preferably abuts on the bottom of the outward-extending flange 53. The upper end of the extrusion 44 is covered with the outward-extending flange 53 from above. A cross-sectional plane of the outward-extending flange 53 preferably is formed into an ellipse larger than the elliptical outer shape of the extrusion 44, with a geometric similarity between the two ellipses. An outer peripheral portion of the outward-extending flange 53 horizontally protrudes outward of an outer face of the extrusion 44.

With particular reference to FIG. 5, above the lower member 48 is a cylindrical portion 57 that protrudes upward to be fitted in tight contact with the lower end of the extrusion 44 in the longitudinal direction. The cylindrical portion 57 complements the extrusion and is fitted into the inner surface of the extrusion 44. The extrusion 44 and the cylindrical portion 57 of the lower member 48 are fastened together with fasteners 47 at their fitting points. A liquid sealing member preferably is interposed between the lower end of the extrusion 44 and the cylindrical portion 57.

Figure 4:
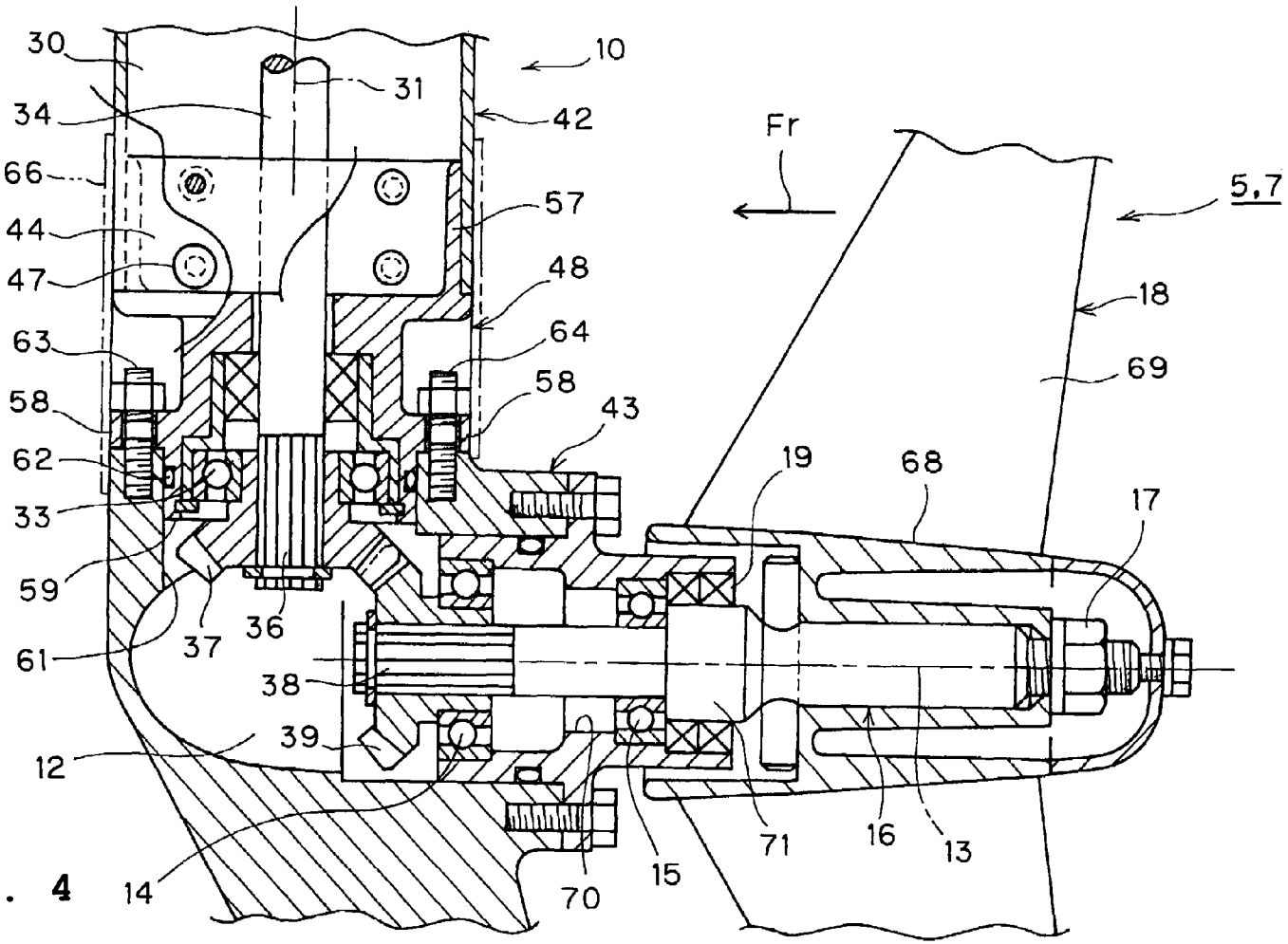
FIG. 4 is a side sectional view of a lower part of the outboard motor.

With particular reference to FIG. 4, below the lower member 48 is formed a front and a rear flange 58. A cylindrical projection 59, which is integral with the flange 58, protrudes downward therefrom on the second axis 31. At least a portion of the upper part of the drive gear 37 is contained within the cylindrical projection 59. The lower end of the drive shaft 34, together with the drive gear 37, are supported by the lower bearing 33 which is in turn supported by the cylindrical projection 59.

The lower case 43 made forms the lower end of the case 10 and preferably is manufactured by aluminum alloy casting. The lower case 43 has an internal space 12 for containing the propeller shaft 16 and the driven gear 39, in which the propeller shaft 16 is supported. The lower case 43 has a circular aperture 61 about the second axis 31, which forms a part of the internal space 12. The cylindrical projection 59, together with the drive gear 37, preferably are detachably fitted into the circular aperture 61. As such, the lower part of the drive gear 37 is contained in the internal space 12 of the lower case 43. The cylindrical projection 59 and the cylindrical aperture 61 preferably are fitted together in tight contact. A circular sealing member 62 preferably is provided about the second axis 31 and interposed between the outer peripheral surface of the cylindrical projection 59 and the inner peripheral surface of the circular aperture 61.

A front and a rear tightening member 63, 64 are provided for connecting the upper and lower cases 42, 43 together. More specifically, the front and rear flanges 58 of the upper case 42 are connected to the top face of the lower case 43 with the front and rear tightening members 63, 64. Preferably, the front and rear tightening members 63, 64 lie generally on the first axis 13. The front tightening member 63 is located adjacent to the front part of the circular aperture 61 while the rear tightening member 64 is located adjacent to the rear part of the circular aperture 61.

A rubber cover member 66 preferably is fitted entirely onto and over the lower end of the extrusion 44 of the upper case 42, the fastener 47, the lower member 48, the upper part of the lower case 43, and the front and rear tightening members 63, 64. The rubber cover member 66 is designed to protect these elements.

The propeller 18 is fitted onto the outer face of the propeller shaft 16 on the first axis 13. The propeller 18 preferably has: a cylindrical boss 68 fastened to the propeller shaft 16 and supported with the fastener 17; and a propeller blade 69 protruding outward from the boss 68 in the radial direction. The front and rear bearings 14, 15 are located rearward of teeth of the drive gear 37. At least a part of the rear bearing 15 is fitted into the inner face of the front end of the boss 68.

A first stopper 70 preferably is provided to prevent the rear bearing 15 from moving forward relative to the lower case 43. In the illustrated embodiment, the first stopper 70 is a ring-shaped projection that is integral with and protrudes from the inner peripheral surface of the internal space 12. A front face of an outer race of the rear bearing 15 abuts against the first stopper 70, thereby preventing the rear bearing 15 from moving forward. A second stopper 71 is provided to prevent the propeller shaft 16 from moving forward relative to the rear bearing 15. The second stopper 71 is a ring-shaped projection that is integral with the propeller shaft 16 and protrudes from an outer peripheral surface of an axial midsection of the propeller shaft 16. A rear face of an inner race of the rear bearing 15 abuts against the second stopper 71, thereby preventing the second stopper 71 from moving forward.

Figure 2:
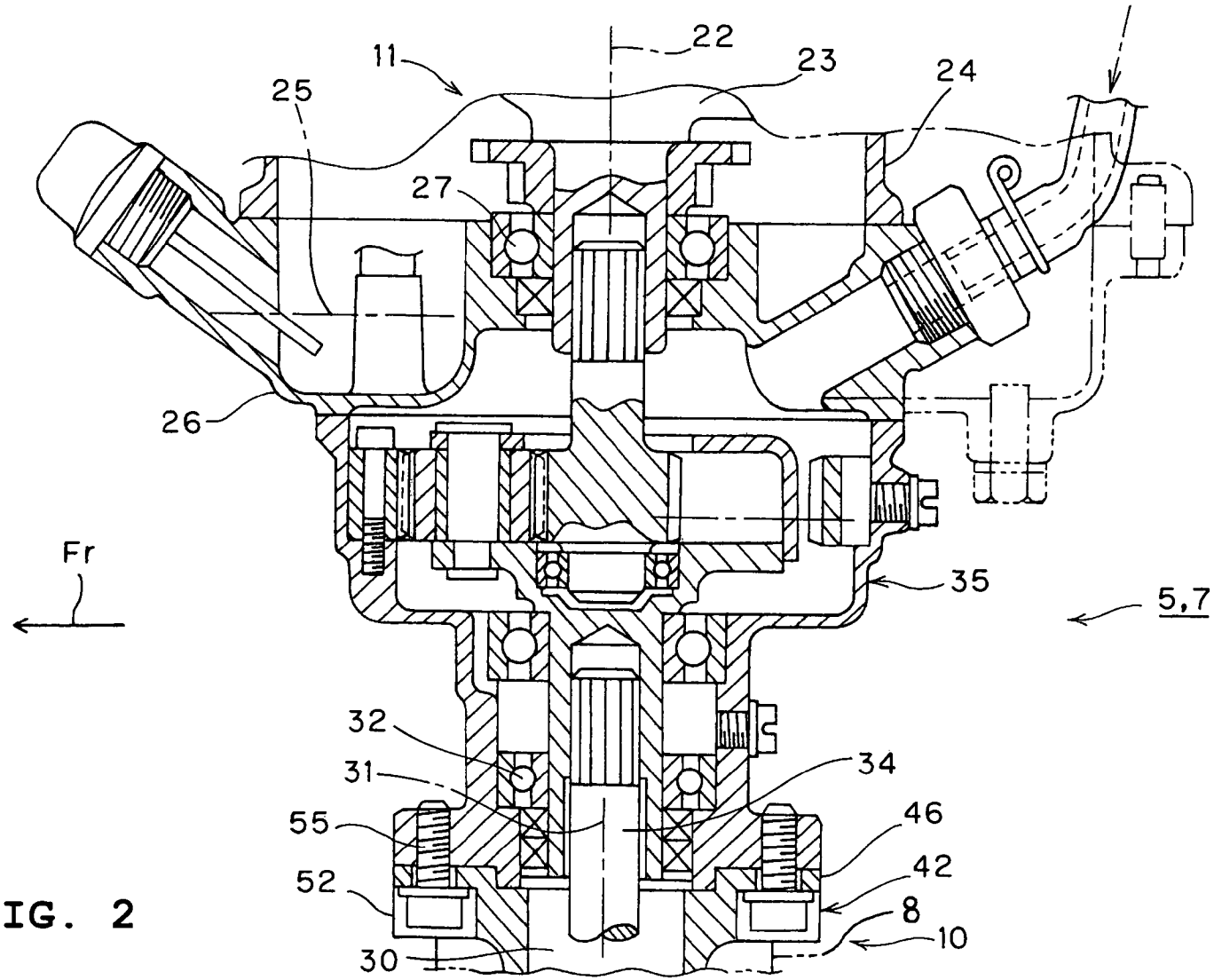
FIG. 2 is a side sectional view of an upper part of the outboard motor.
Figure 7:
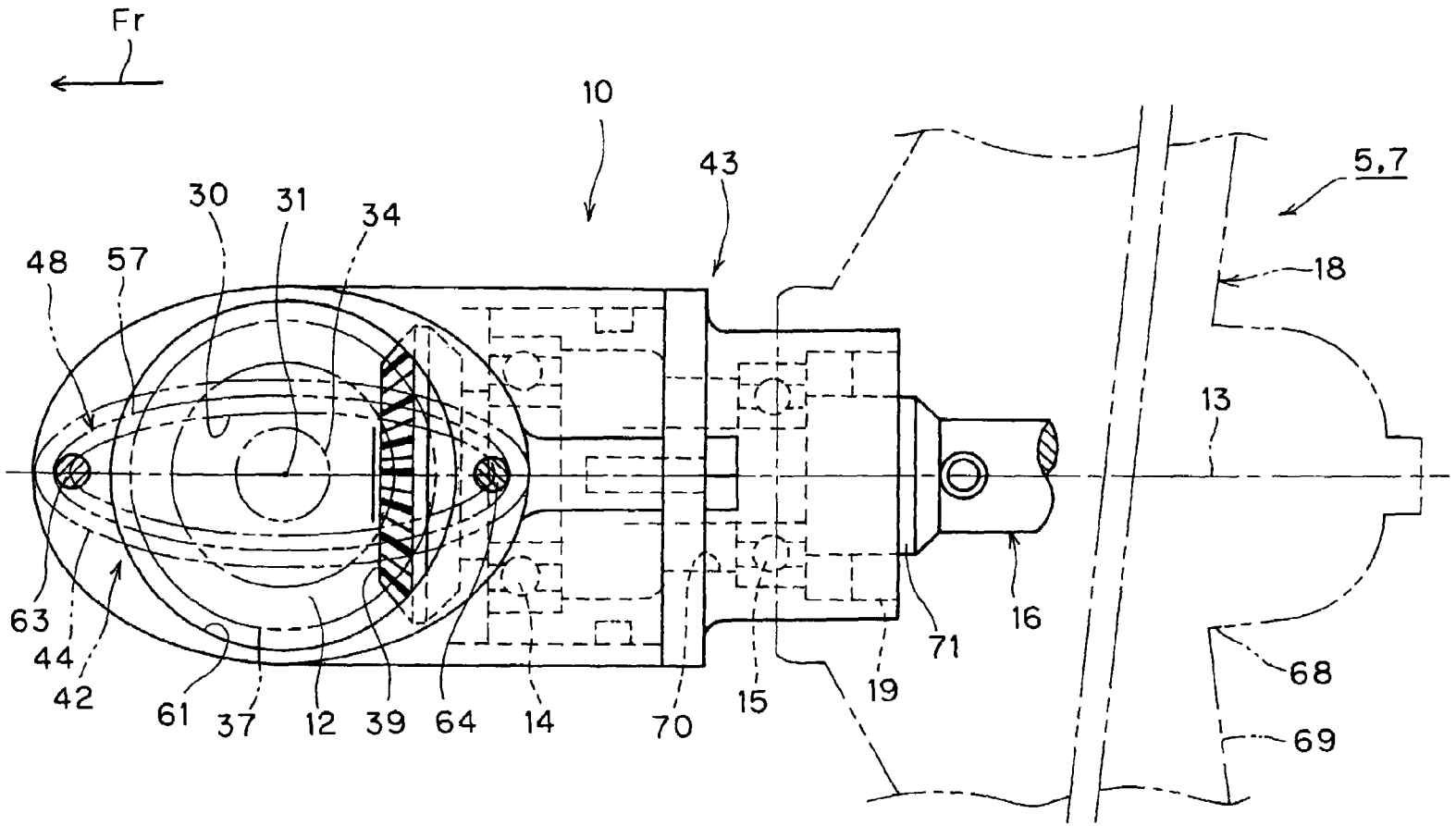
FIG. 7 is a bottom plan view of the outboard motor.

With particular reference next to FIGS. 2, 4, and 7, when the engine 11 of the outboard motor 5 is driven, a drive force of the engine 11 is reduced by the reduction gear 35 and then transmitted to the propeller 18 through the drive shaft 34, the drive gear 37, the driven gear 39 and the propeller shaft 16. This causes the propeller 18 to rotate to drive the boat 1 ahead. Under this condition, the propeller shaft 16 tends to move forward relative to the lower case 43, which is prevented by the rear bearing 15 and the first and second stoppers 70,71.

With reference again to FIGS. 1-7, employing an elongate extruded portion 44 as at least part of the upper case provides certain advantages and improvements. For example, an extruded portion 44 can be constructed having significantly less weight than a corresponding casted portion. As such, an outboard motor employing such an extrusion is not as heavy as a typical outboard motor. Such an extrusion results in a lighter outboard motor that is easier to work with during manufacture, and uses less material during manufacture. The lower-weight outboard motor is also easier for the user to manipulate and use. Therefore, both manufacturing and consumer use is made easier.

Additionally, boat hulls vary significantly in dimensions, particularly in their height. With a traditional, casted case, it is difficult to appropriately match the the outboard motor height to the height of the corresponding boat hull. That is because a separate mold is required for casting each size of case. This makes manufacturing multiple case lengths cumbersome and difficult. In accordance with an embodiment, the extrusion 44 has substantially the same cross-sectional dimensions throughout its length. Accordingly, different lengths of extrusions can be obtained simply by selectively cutting the extrusion at a desired length. No specialized mold or casting process need be created for each different length of the case. This improves the flexibility during manufacture, as it becomes relatively easy and inexpensive to manufacture outboard motors having different case lengths.

In the illustrated embodiment, a planar cross section of the extrusion 44 is shaped as an ellipse having a major axis extending generally in a longitudinal direction of the hull 3. This configuration decreases the propulsion resistance of the boat relative to a differently shaped case, such as a more circular cross-section case. It is to be understood that other cross-sectional shapes of the extrusion can also be utilized so as to minimize propulsion resistance as the outboard motor, including the case, moves through the water.

In the illustrated embodiment, engine 11 is air-cooled and discharges exhaust gas 28 directly to the air. As such, the case 10 needs no water passage for delivering water from under the water surface 2 to the engine 11 for cooling. Nor does the case 10 need to accommodate an exhaust passage for leading exhaust gas 28 from the engine 11 to a below-the-water-surface exhaust outlet. This simplifies the manufacturing process, as the extrusion 44 is relatively simple to make. In addition, since no water passage or exhaust passage extends through the case 10, the case will have a decreased cross-sectional area and profile in extrusion 44. This further reduces the propulsion resistance of the outboard motor as it moves through the water.

In additional embodiments, the extrusion can employ some passages such as a water supply pipe and/or an exhaust passage. In some embodiments, it may be difficult to extrude such passages. Thus, in some further embodiments, the extrusion is sized so as to accommodate a separately formed water passage and/or exhaust passage.

As described above, the case 10 on its upper side has: the extrusion 44 that forms the longitudinal midsection thereof; the upper member 46 that is fitted to the upper end of the extrusion 44 in the longitudinal direction so that the upper member 46 and the upper end of the extrusion 44 are connected together to the engine 11 side; and the fastener 45 for connecting the extrusion 44 and the upper member 46 together at their fitting points.

Thus, in the illustrated embodiment no specific machining process such as pressing, is necessary to connect the upper end of the extrusion 44 to the engine 11 side. In other words, the cross-sectional plane of the extrusion 44 at its upper end can remain unchanged geometrically after extrusion molding. Accordingly, the molding process of the case 10 can be easier, that is, the molding process of the outboard motor 5 can be easier.

In addition, as noted previously, the upper member 46 has: the cylindrical portion 54 fitted to the upper end of the extrusion 44; and the outward-extending flange 53 which is integral with the upper end of the cylindrical portion 54, and which covers the upper end of the extrusion 44 from above so that the outward-extending flange 53 and the upper end of the extrusion 44 are connected together to the engine 11 side.

When the boat 1 is driven ahead by the outboard motor 5, the water impacts the front side of the extrusion 44. At least some of this water is pushed upward toward the engine 11. Preferably, such water flow is blocked from reaching the engine 11 by the outward-extending flange 53.

The above description is based on the illustrated examples. However, the engine 11 may be a two-stroke engine or a multi-cylinder engine. In addition, the scope of the definition of the fastener 45 covers a tightening member and welding as well as other methods and apparatus for fastening members together. Also, the cross-sectional plane of the extrusion 44 may be shaped into a circle.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An outboard motor adapted to be mounted to a hull of a watercraft, the outboard motor comprising an engine adapted to drive a generally vertically oriented driveshaft, the driveshaft adapted to drive a propulsion shaft, an upper case extending generally vertically and adapted to fit circumferentially about at least a portion of the driveshaft, a lower case adapted to fit about at least a portion of the propulsion shaft, wherein the upper case comprises an elongate extrusion portion, a cross-sectional planar shape of the extrusion portion being substantially constant throughout its length, and wherein the extrusion portion has an outer surface, and a cross-section of the extrusion portion taken at a plane transverse to a longitudinal center line of the extrusion portion has a major axis and a minor axis, the major axis being greater than the minor axis, and a mount portion adapted to attach to the hull of a watercraft, the mount portion having a bracket adapted to rotatably support the outboard motor, wherein the extrusion portion is arranged vertically below the bracket, and wherein the hull is adapted to float in a body of water, and the outboard motor is configured so that when the hull is floating in a body of water, a portion of the extrusion portion is under a surface of the water.

2. An outboard motor as in claim 1, wherein the extrusion portion is generally elliptical in cross-section.

3. An outboard motor as in claim 1, wherein the engine is an air-cooled engine.

4. An outboard motor adapted to be mounted to a hull of a watercraft, the outboard motor comprising an engine adapted to drive a generally vertically oriented driveshaft, the driveshaft adapted to drive a propulsion shaft, an upper case extending generally vertically and adapted to fit circumferentially about at least a portion of the driveshaft, a lower case adapted to fit about at least a portion of the propulsion shaft, and a mount portion adapted to attach to the hull of a watercraft, the mount portion having a bracket adapted to support the outboard motor, wherein the upper case comprises an extrusion portion, an upper member fitted to an upper end of the extrusion portion, and a fastener for connecting the extrusion to the upper member, a cross-sectional planar shape of the extrusion portion being substantially constant throughout its length, wherein the upper member is rotatably supported by the bracket and extends downwardly below the bracket, and the extrusion portion is fitted to the upper member below the bracket.

5. An outboard motor as in claim 4, wherein the extrusion portion has an outer surface, and a cross-section of the extrusion portion taken at a plane transverse to a longitudinal center line of the extrusion portion has a major axis and a minor axis, the major axis being greater than the minor axis.

6. An outboard motor as in claim 4, wherein the upper member is formed by casting.

7. An outboard motor as in claim 4, wherein the upper member comprises a depending portion shaped and configured to complementarily engage the upper end of the extrusion portion.

8. An outboard motor as in claim 7, wherein the upper member additionally comprises a flange portion formed integrally with the depending portion, the flange portion extending outwardly relative to the depending portion.

9. An outboard motor as in claim 8, wherein the upper end of the extrusion portion substantially abuts the flange portion.

10. A method of making an outboard motor, comprising providing an engine adapted to drive an elongate driveshaft, providing a case adapted to generally enclose the driveshaft along at least a portion of its length, and providing a mount having a bracket adapted to support the outboard motor, wherein providing the case comprises providing an upper member, arranging the upper member over the driveshaft, attaching a first end of the upper member to the engine, fitting the upper member through the bracket so that the upper member is rotatably supported by the bracket and a second end of the upper member is disposed below the bracket, extruding an elongate tubular portion, arranging the elongate extruded portion over the driveshaft, providing a mount portion on the second end of the upper member that is shaped complementarily to an upper end of the extruded portion, and attaching the extruded portion to the upper member mount portion, wherein a planar cross-section of the extruded portion is substantially the same throughout its length.

11. A method as in claim 10, wherein the extruded portion comprises an aluminum alloy.

12. A method as in claim 10, wherein providing the upper member comprises casting the upper member.

13. A method of making an outboard motor, comprising providing an engine adapted to drive an elongate driveshaft, providing a case adapted to generally enclose the driveshaft along at least a portion of its length, and providing a mount having a bracket adapted to support the outboard motor, wherein providing the case comprises providing an upper member, arranging the upper member over the driveshaft, attaching a first end of the upper member to the engine, fitting the upper member through the bracket so that the upper member is rotatably supported by the bracket and a second end of the upper member is disposed below the bracket, extruding an elongate tubular portion, arranging the elongate extruded portion over the driveshaft, providing a mount portion on the second end of the upper member that is shaped complementarily to an upper end of the extruded portion, and attaching the extruded portion to the upper member mount portion, wherein a planar cross-section of the extruded portion is generally elliptical.

* * * * *